US005416928A

United States Patent [19]

Koenig

[11] Patent Number: 5,416,928

[45] Date of Patent: May 23, 1995

[54] VERSATILE GARMENT ATTACHMENT AND ARTICLE OF CLOTHING

[76] Inventor: Eric Koenig, 30 Forest Dr., Lloyd Neck, N.Y. 11743

[21] Appl. No.: 183,817

[22] Filed: Jan. 21, 1994

[51] Int. Cl.[6] ..... A41D 27/08

[52] U.S. Cl. ..... 2/244; 2/227; 2/105; 2/106

[58] Field of Search ..... 2/244, 46, 85, 93, 69, 2/108, 227, 115, 105, 106, 124, 122, 209.13

[56] References Cited

U.S. PATENT DOCUMENTS

| | | | |
|---|---|---|---|
| 2,556,039 | 6/1951 | Landert | 2/106 |
| 2,688,136 | 9/1954 | Freedman | 2/244 |
| 4,754,500 | 7/1988 | Brucato et al. | 2/105 |
| 5,086,516 | 2/1992 | Baxter et al. | 2/108 |
| 5,168,580 | 12/1992 | Foo | 2/115 |

*Primary Examiner*—Clifford D. Crowder
*Assistant Examiner*—Gloria Hale
*Attorney, Agent, or Firm*—Michael I. Kroll

[57] ABSTRACT

A versatile garment attachment and article of clothing is provided, which consists of a decorative flexible panel. A garment is worn on a portion of a body of a person. A structure is for attaching in a removable manner the decorative flexible panel to the garment, to create a plurality of different wearable styles for the garment. Components can also be provided for connecting in a removable manner the decorative flexible panel to itself or to a second decorative flexible panel, to create a plurality of different wearable styles.

2 Claims, 2 Drawing Sheets

18
10
12
34
36
18
12

10
38
12
18
52,54
50

12
18
52,54
10
12
50
2A
2A 14
12
16
56
14
12
16
60
62
14
58
16
12
14
12
16
66
64

12
50
12
46
10
48
10
12
18
12
52,54
50

12
10
52,54
18
40
50

42
12
10
52,54
18
50

12
10
44
18
50
52,54

VERSATILE GARMENT ATTACHMENT AND ARTICLE OF CLOTHING

BACKGROUND OF THE INVENTION

1. Field of the Invention

The instant invention relates generally to wearing apparel and more specifically it relates to a versatile garment attachment and article of clothing.

2. Description of the Prior Art

Numerous wearing apparel have been provided in prior art. For example, U.S. Pat. Nos. 2,457,309 to Joyce; 4,776,043 to Coleman; 4,975,987 to Teachout et al; 4,993,078 to Seitz, Jr; 5,159,718 to Moyer and 5,168,580 to Foo all are illustrative of such prior art. While these units may be suitable for the particular purpose to which they address, they would not be as suitable for the purposes of the present invention as heretofore described.

A fabric comprising at least four individual units secured together. Each of the units consisting of two pieces of cloth of the same size and shape and different color. The two pieces of cloth are secured together along their edges over a portion of the length thereof and have their remaining portions oppositely disposed. The resulting double thickness portion is foldable from one extreme position to another along a line connecting the terminations of the secured portions. The single thickness portions of the unit are secured to an adjacent single thickness portion of a corresponding unit of the same size and shape. At least four of these units are secured together to produce a decorative panel or piece of fabric of the desired size and shape. Fastening members are secured on the fabric. Cooperative fastening members are secured to the foldable portion of each unit. The foldable portion is secured in either one or the other extreme position by the fastening members, whereby upon such movement and fastening the appearance of the fabric is materially changed as by design, color or both.

The present invention provides an improved hat with interchangeable patches that can be selectively attached to the hat. In the preferred embodiment, the hat is a standard, billed, baseball-style cap with some portion of a phrase or logo printed on its front surface. A strip of fastening material or adhesive is secured to the hat just below the incomplete phrase. A plurality of separate patches are each printed with a different completion to the hat's printed phrase or logo, and are each with a back surface that is attachable to the fastening material on the hat. Thus the user can select the completion of the phrase with the patch of his choice. In this way, a single hat can be used to carry a variety of different, and changing, phrases and logos.

An attachment mechanism and system, for the ornamentation of and on articles of clothing (i.e., shirts, blouses, dresses, pants, skirts, shorts, overalls, jackets, etc.). The article of clothing has a first strip of material, the system's receiving loop forming element, affixed to it. This strip is sewn or otherwise attached at its two ends to the article of clothing, leaving the center section spaced from the article to form the receiving loop upon the article of clothing. This receiving strip can be attached to any chosen display area upon the garment's exterior. Customized fabric receiving strips could also become the clothing manufacturer's vanity/display label. In one embodiment, the ornamentation, preferably of soft composition, has an attachment strip attached to the back side or it's top section wherein the strip ends are releasably interconnected to form an attachment loop. One end of the strip providing the open attachment loop extends through the receiving loop and closes to itself, end to end, thereby interlocking the attachment loop to the receiving loop and completing the ornament attachment. Variations include a second receiving loop on the ornament; ornaments with a slotted back; or a third loop, eyelet or clip used to complete the ornament to garment attachment.

An improved modification to a typical T-shirt, to convert it into a full headdress, by adding first and second strips of releasable, press-together bonding material, such as Velcro (trademark) in spaced apart relation on one of the shirt torso panels near the panel-sleeve seam. One set is above the other, so that when the top of the shirt is folded downward, one-half the depth of the sleeves, to place the first strip on one side of the shirt and the second strip on the other side of the shirt, and the torso-covering panels draped over the wearer's head and down over the rear of the wearer's neck, the folded sleeves may be wrapped rearward about the head and brought into overlapping contact along the strips to form the headdress.

A safety hunter's garment that permits the selective interchangeability of camouflage on the garment to a plurality of bands of Hunter's orange, which is blazing fluorescent orange, by simply reversing the bands to expose or cover the selected mode. An arrangement of a plurality of fasteners on the band of opposed materials of camouflage and Hunter's orange enable this exchange.

An attractive jacket design having removable and changeable panels that has the overall effect of lowering the cost of sport jackets. With this invention, chest, shoulder and back panels on the jacket are easily removable and changeable in order to allow a user of the jacket to use one set of patches with the jacket for one purpose or event and to remove those patches from the jacket and put another set of patches on the jacket for another purpose or event. This permits the manufacture of a set of patches for various teams, rather than a set of jackets, thus reducing overall manufacturing cost.

SUMMARY OF THE INVENTION

A primary object of the present invention is to provide a versatile garment attachment and article of clothing that will overcome the shortcomings of the prior art devices.

Another object is to provide a versatile garment attachment and article of clothing that is a decorative flexible panel that can be used by itself, with another panel or with a garment to create many different wearable styles.

An additional object is to provide a versatile garment attachment and article of clothing that can be attached in a removable manner to itself, to another panel or to a garment, so as to make interchangeable wearable styles.

A further object is to provide a versatile garment attachment and article of clothing that is simple and easy to use.

A still further object is to provide a versatile garment attachment and article of clothing that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
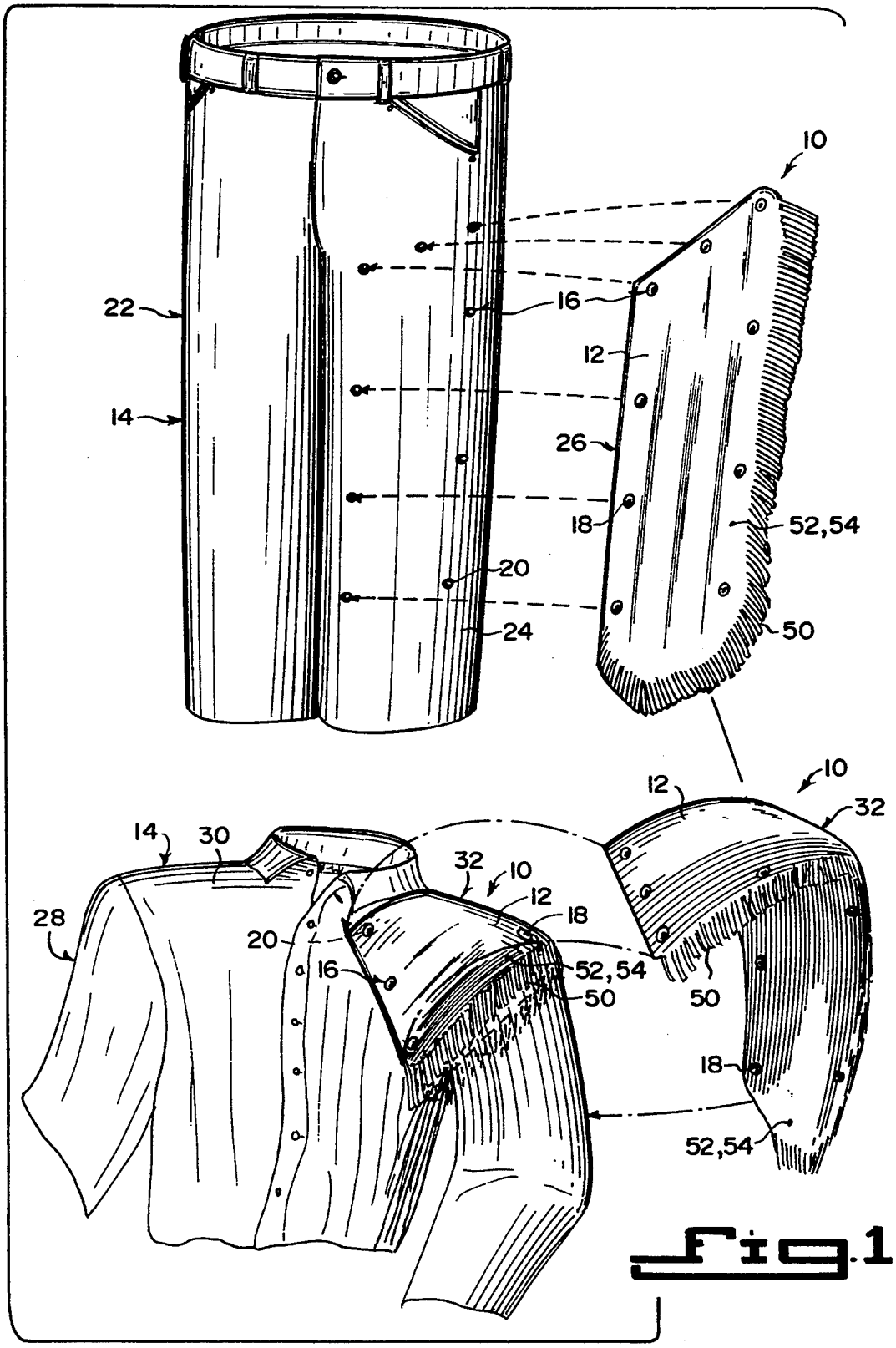
FIG. 1 is a perspective view of the invention ready to be removably attached in a removable manner to a leg of a pair of pants and the shoulder of a jacket.

Turning now descriptively to the drawings, in which similar reference characters denote similar elements throughout the several views, FIG. 1 illustrates a versatile garment attachment and article of clothing 10, which consists of a decorative flexible panel 12. A garment 14 is worn on a portion of a body of a person. A structure 16 is for attaching in a removable manner the decorative flexible panel 12 to the garment 14, to create a plurality of different wearable styles for the garment 14.

The attaching structure 16 includes a plurality of female snap fasteners 18, affixed in spaced apart relationships about the perimeter of the decorative flexible panel 12. A plurality of male snap fasteners 20 are affixed in matching spaced apart relationships to the garment 14. The female snap fasteners 18 on the decorative flexible panel 12 can mate with the male snap fasteners 20, to hold the decorative flexible panel 12 to the garment 14.

The garment 14 can be a pair of pants 22, having leg portions 24. The male snap fasteners 20 are affixed to one of the leg portions 24. When the female snap fasteners 18 on the decorative flexible panel 12 mate with the male snap fasteners 20, a leg covering 26 will be created thereon.

The garment 14 can also be a jacket 28, having shoulder portions 30. The male snap fasteners 20 are affixed to one of the shoulder portions 30. When the female snap fasteners 18 on the decorative flexible panel 12 mate with the male snap fasteners 20, a shoulder shawl 32 will be created thereon.

Figures 2, 2A, 2B, 3, 4, 5, 6, 7:
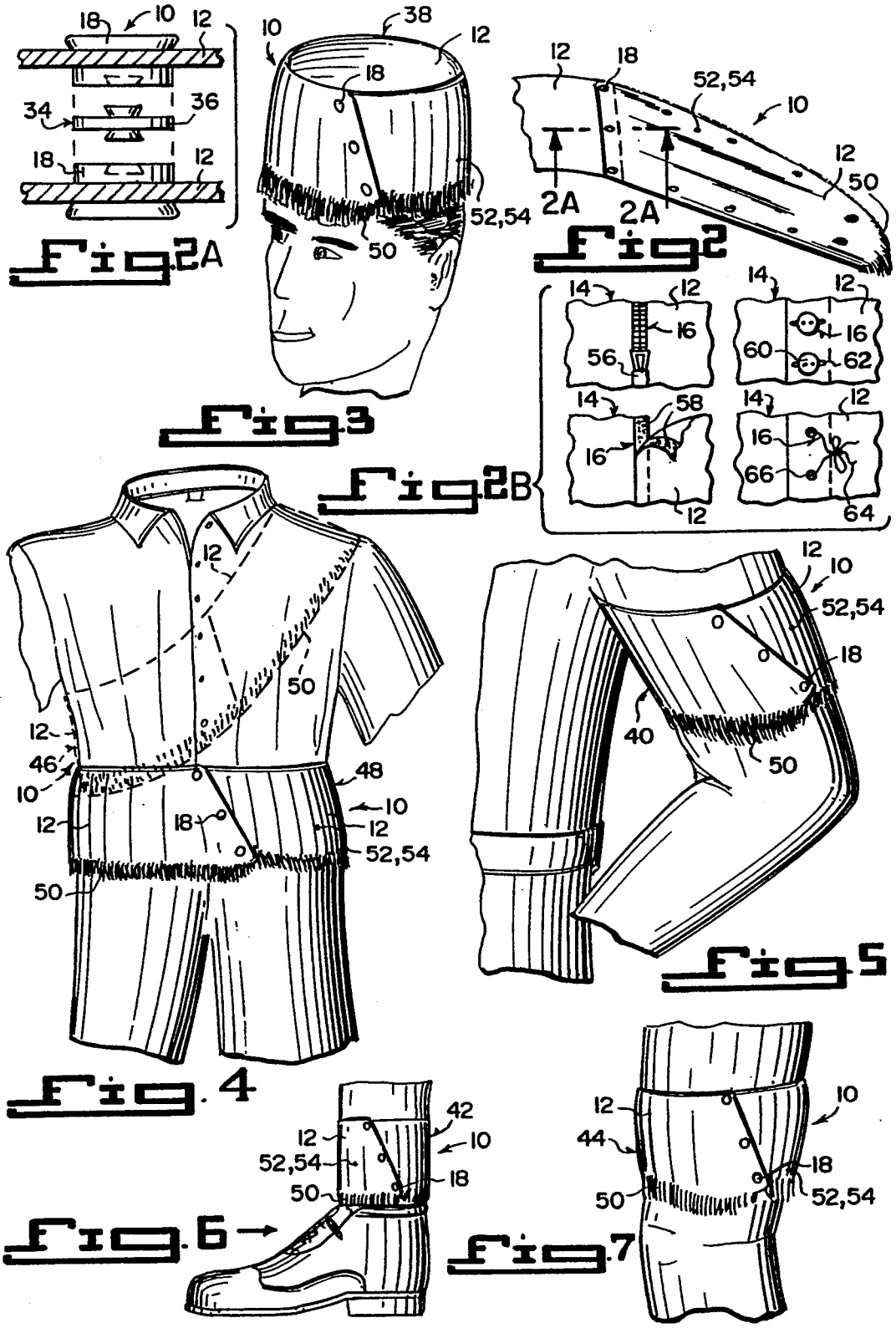
FIG. 2 is a plan view showing two of the decorative flexible panels attached in a removable manner together.
FIG. 2A is an exploded cross sectional view taken along line 2A—2A in FIG. 2, showing one typical double male snap fastener adaptor.
FIG. 2B is a plan view showing other types of attaching structures.
FIG. 3 is a perspective view of the invention being used as a headband.
FIG. 4 is a perspective view showing two of the decorative flexible panels in phantom being used as a bandoleer and two others being used as a belt.
FIG. 5 is a perspective view showing the invention being used as an arm band.
FIG. 6 is an elevational view showing the invention being used as a ankle band.
FIG. 7 is an elevational view showing the invention being used as a leg band.

Components 34, one of which is best seen in FIG. 2A, is for connecting in a removable manner the decorative flexible panel 12 in a first instance to itself and in a second instance to a second decorative flexible panel 12, to create a plurality of different wearable styles.

The connecting components 34 are a plurality of double male snap fastener adaptors 36. Each adaptor 36 will allow two female snap fasteners 18 to mate thereto. If one decorative flexible panel 12 is connected to itself, a headband 38 shown in FIG. 3, an arm band 40 shown in FIG. 5, an ankle band 42 shown in FIG. 6 and a leg band 44 shown in FIG. 7, can be created. If two decorative flexible panels 12 are connected together, as shown in FIG. 2, a bandoleer 46 and a belt 48 can be created (see FIG. 4).

The decorative flexible panel 12 further includes a fringe 50 being an ornamental border of short hanging strips on at least one edge thereof. The decorative flexible panel 12 can be fabricated out of a thin piece of leather 52 or out of a piece of fabric 54.

As shown in FIG. 2B, the attaching structure 16 can be a plurality of slide fasteners 56 between the edges of the decorative flexible panel 12 and the garment 14. The attaching structure 16 can be a plurality of mating hook and loop pile fastener material strips 58 between the edges of the decorative flexible panel 12 and the garment 14. The attaching structure 16 can be a plurality of buttons 60 and button holes 62 between the edges of the decorative flexible panel 12 and the garment 14. The attaching structure 16 can also be a plurality of laces 64 and eyelets 66 between the edges of the decorative flexible panel 12 and the garment 14.

OPERATION OF THE INVENTION

To use the decorative flexible panel 12, the following steps should be taken:

1. Attach all of the female snap fasteners 18 on the decorative flexible panel 12 to all of the male snap fasteners 20 on the leg portion 24 of the pair of pants 22, to create the leg covering 26.

2. Attach all of the female snap fasteners 18 on the decorative flexible panel 12 to all of the male snap fasteners 20 on the shoulder portion 30 of the jacket 28, to create the shoulder shawl 32.

3. Attach the double male snap fastener adaptors 36 between the female snap fasteners 18 on opposite ends of one decorative flexible panel 12, to create the headband 38, the arm band 40, the ankle band 42 and the leg band 44.

4. Attach the double male snap fastener adaptors 36 between the female snap fasteners 18 on overlapping ends of two decorative flexible panels 12, to create the bandoleer 46 and the belt 48.

LIST OF REFERENCE NUMBERS

10 versatile garment attachment and article of clothing
12 decorative flexible panel garment
16 attaching structure between 12, 14
18 female snap fastener on 12
20 male snap fastener on 14
22 pair of pants for 14
24 leg portion of 22
26 leg covering
28 jacket
30 shoulder portion of 28
32 shoulder shawl
34 connecting component
36 double male snap fastener adaptor for 34
38 headband
40 arm band 42 ankle band
44 leg band
46 bandoleer
48 belt
50 fringe on 12
52 thin piece of leather :for 12
54 piece of fabric for 12

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A versatile garment attachment and article of clothing which comprises:

a) a decorative flexible panel, said decorative flexible panel further including a fringe being an ornamental border of short hanging strips on at least one edge thereof, said decorative flexible panel being fabricated out of a thin piece of leather, said decorative flexible panel further being fabricated out of a piece of fabric;

b) a garment worn on a portion of a body of a person, said garment being a pair of pants having leg portions with said male snap fasteners affixed to one of said leg portions, so that when said female snap fasteners on said decorative flexible panel mate with said male snap fasteners, a leg covering will be created thereon, said garment further being a jacket having shoulder portions with said male snap fasteners affixed to one of said shoulder portions, so that when said female snap fasteners on said decorative flexible panel mate with said male snap fasteners, a shoulder shawl will be created thereon;

c) means for attaching in a removable manner said decorative flexible panel to said garment, to create a plurality of different wearable styles for said garment, said attaching means including a plurality of female snap fasteners affixed in spaced apart relationships about the perimeter of said decorative flexible panel, said attaching means further including a plurality of male snap fasteners affixed in matching spaced apart relationships to said garment, so that said female snap fasteners on said decorative flexible panel can mate with said male snap fasteners, to hold said decorative flexible panel to said garment, said attaching means including a plurality of slide fasteners between the edges of said decorative flexible panel and said garment, said attaching means further including a plurality of mating hook and loop pile fastener material strips between the edges of said decorative flexible panel and said garment, said attaching means further including a plurality of buttons and button holes between the edges of said decorative flexible panel and said garment, and said attaching means further including a plurality of laces and eyelets between the edges of said decorative flexible panel and said garment;

d) means for connecting in a removable manner said decorative flexible panel in a first instance to itself and in a second instance to a second decorative flexible panel, to create a plurality of different wearable styles.

2. A versatile garment attachment and article of clothing as recited in claim 1, wherein said connecting means includes a plurality of double male snap fastener adaptors, in which each said adaptor will allow two said female snap fasteners to mate thereto, so that if one said decorative flexible panel is connected to itself, a headband, an arm band, an ankle band and a leg band can be created, and if two said decorative flexible panels are connected together a bandoleer and a belt can be created.

* * * * *